United States Patent [19]

Monroe

[11] 4,363,284

[45] Dec. 14, 1982

[54] DOCK-SIDE BOAT COVER

[76] Inventor: William E. Monroe, R.R. #3, Box 386, Syracuse, Ind. 46567

[21] Appl. No.: 225,351

[22] Filed: Jan. 15, 1981

[51] Int. Cl.[3] ..... B63B 17/02

[52] U.S. Cl. ..... 114/361; 135/102

[58] Field of Search ..... 9/1.5; 114/263, 361; 272/118; 182/133–135; 135/5 R, 6, 8

[56] References Cited

U.S. PATENT DOCUMENTS

| | | | |
|---|---|---|---|
| 1,114,057 | 10/1914 | Spalding | 135/8 |
| 2,082,553 | 6/1937 | Shaw et al. | 182/134 |
| 3,912,263 | 10/1975 | Yatso | 272/118 |
| 4,019,212 | 4/1977 | Downer | 9/1.5 |

*Primary Examiner*—Sherman D. Basinger

[57] ABSTRACT

A cover for protecting the interior of a boat from the surrounding environment. The cover has first and second vertical supports connected to a dock. A horizontal member is connected with the first and second vertical supports to form a frame. First and second brackets are located on the first and second vertical supports. The first and second brackets have arms attached thereto that extend from the dock toward the water. A canopy is attached to the arms. A winch has cables connected to the first and second brackets to move the canopy with respect to the boat from a first position where flaps surround that portion of the boat out of the water, to a second position which allows unhampered ingress and egress between the boat and dock.

12 Claims, 8 Drawing Figures

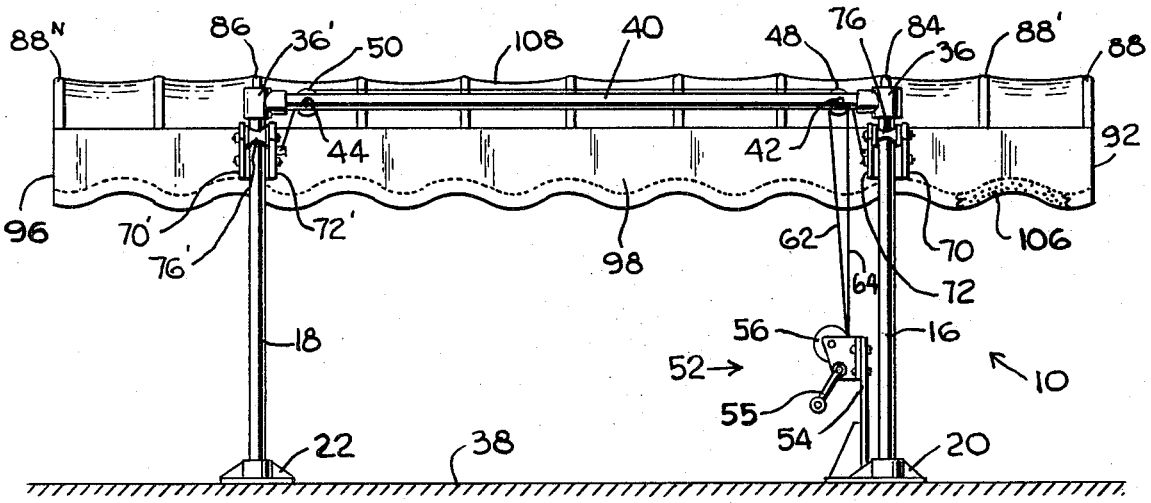
Fig. 1
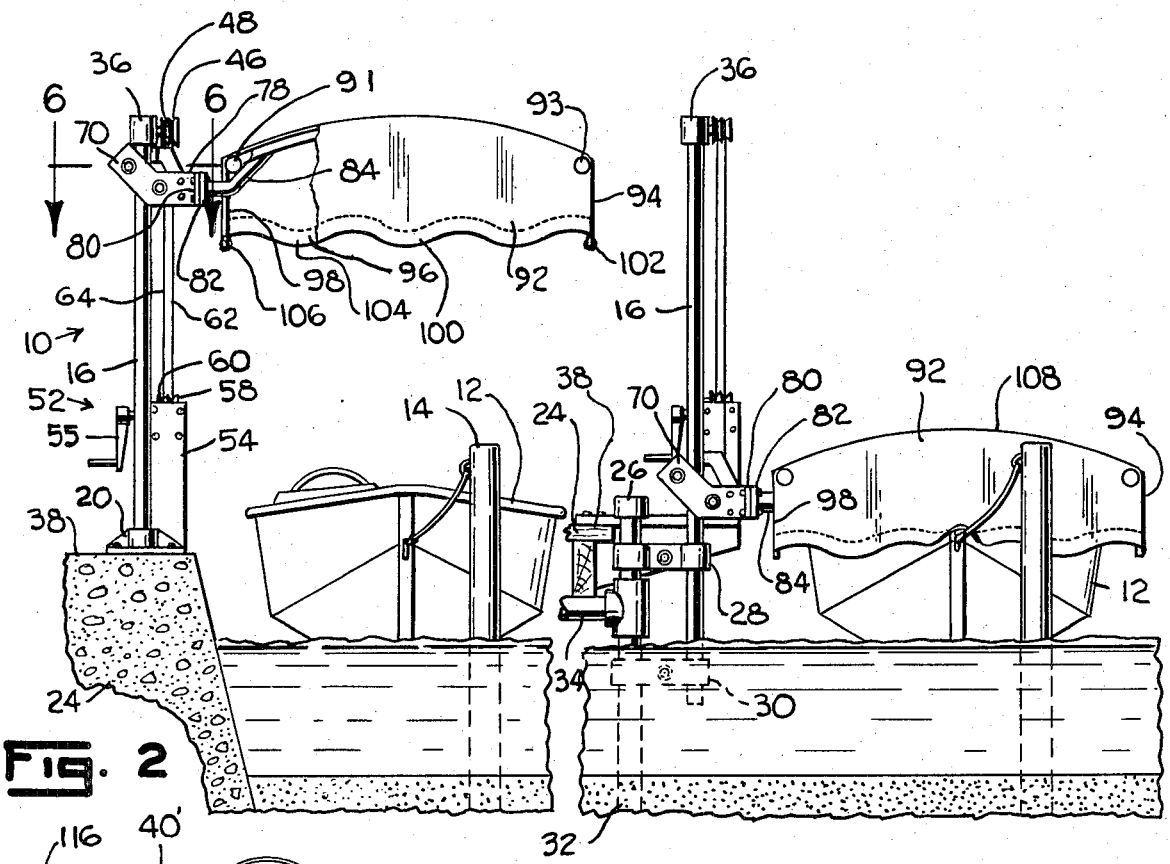
Fig. 2
Fig. 3
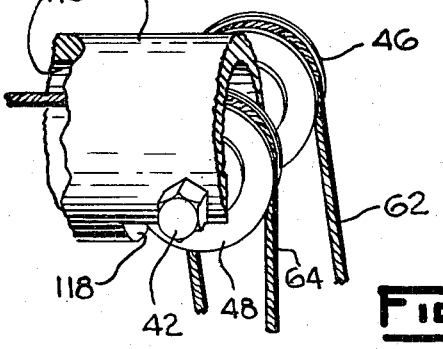
Fig. 8

UP
DN

DOCK-SIDE BOAT COVER

BACKGROUND OF THE INVENTION

This invention relates to a movable cover for protecting the interior of a boat from the surrounding environment.

Small boats, such as used by fishermen and pleasure run-about craft, are usually not enclosed. This type boat is normally only used on inland waterways, or lakes, and are not designed for habitation. Rather than taking the boat out of the water after every use, most operators tie their boats to a dock or pier. Unfortunately, the top of such boats are almost level with the shore line. Thus, when the wind blows, debris from the surrounding environment often is deposited in the interior of the boat. In addition, should a storm come up, rain is retained in the interior of the boat which can result in a bail job for the operator before the next use of the boat.

SUMMARY OF THE INVENTION

In the present invention, a dock-side cover provides protection for a boat that is secured to a dock or pier.

The dock-side cover has first and second vertical supports attached to the dock. First and second brackets located on the first and second vertical supports, respectively, have arms that extend over the water adjacent to the dock. A canopy secured to the arms has flaps that form a skirt. Weights or stiffeners on the periphery of the flaps hold the skirt in a substantially vertical plane. A winch which has first and second cables attached to the first and second brackets responds to an input signal to move the canopy from a first position where the skirt surrounds at least a portion of the boat out of the water to a second position which allows unhampered ingress and egress from the boat to the dock.

An advantageous effect of this invention results from the protection provided the interior of the boat from the surrounding environment when it is secured to a dock.

It is an object of this invention to provide a cover that protects the interior of a boat when secured to a dock. The cover is moved from a first position where a skirt surrounds at least a portion of the boat out of the water to a second position where ingress and egress between the boat and dock is unhampered.

These and other advantages and objects should be apparent from reading this specification while viewing the drawings.

BRIEF DESCRIPTION OF THE DRAWINGS

FIG. 1 is a side view of a dock-side cover for a boat made according to the principals of this invention;

FIG. 2 is an end view of the dock-side cover of FIG. 1 with a boat secured to a pier and the cover in an up position;

FIG. 3 is an end view of a dock-side cover with the cover in a down position;

FIG. 8 is an enlarged view of a horizontal member and sheaves with an operational cable located in a bore of the horizontal member.

DETAILED DESCRIPTION OF THE INVENTION

Figures 4, 5, 6, 7:
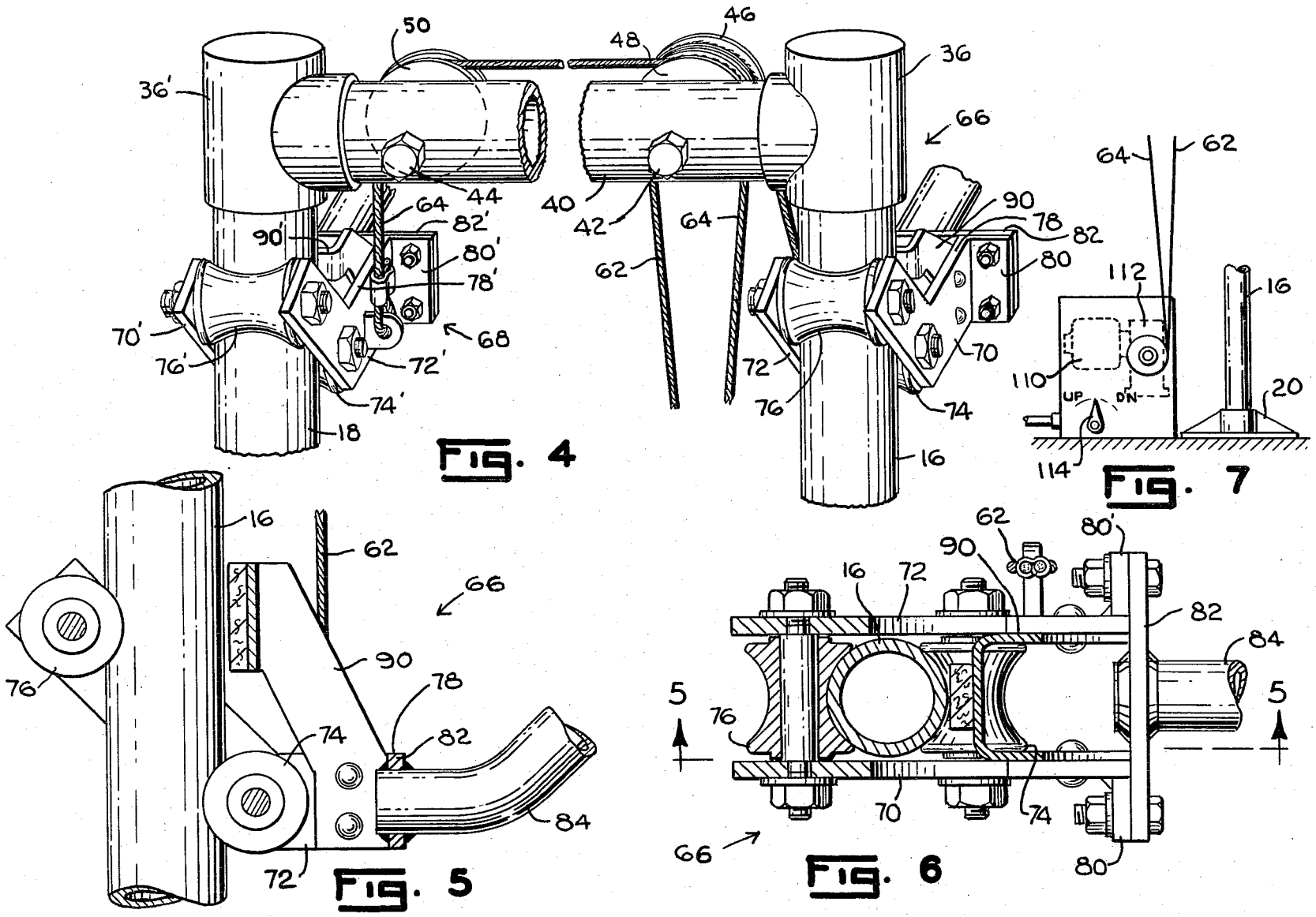
FIG. 4 is an enlarged view of a section of the vertical supports, horizontal member, sheaves, brackets and cables of the cover in FIG. 1.
FIG. 5 is a side view of a bracket and vertical support taken along line 5—5 in FIG. 6.
FIG. 6 is a sectional view taken along line 6—6 in FIG. 2.
FIG. 7 is a partial end view of a dock-side cover showing an electrical motor for providing the operational cables with an input force to move the canopy.

The dock-side cover 10 shown in FIG. 1 is designed to protect a boat 12 that is tied to a pier or post 14, as shown in FIGS. 2 and 3, from the surrounding environment.

The dock-side cover 10 has first and second vertical supports 16 and 18 with base plates 20 and 22 that are secured to a dock, sea wall or pier 24. Under some circumstances the vertical supports 16 and 18 are attached to a guy member 26 shown in FIG. 3 by fasteners 28 and 30. Each guy member 26 has an end 32 that is anchored in soil adjacent the dock 24. A brace 34 which extends from the dock 24 holds the guy member 26 in a vertical position. The fasteners 28 and 30 are clamps that can be loosened to adjust the position of the end 36 with respect to the planer surface 38 of dock 24.

Throughout this specification where like items are used for the same purpose, a′ may be added to the number for identification purposes.

The ends 36, 36′ of the vertical supports 16 and 18 are connected to each other by horizontal member 40 to form a rigid frame.

First and second shafts or axles 42 and 44 are located on horizontal member 40 adjacent vertical supports 16 and 18, respectively. First and second sheaves 46 and 48 are located on shaft 42 and a third sheave 50 is located on shaft 44.

A winch 52 is located on a fixture 54 which is fixed to either the dock 24 or vertical support 16. The winch 52 has a drum or spool 56 with first and second sheaves 58 and 60 that are separated by a spacer. As best shown in FIGS. 2 and 4, a first cable 62 located on sheaves 58 and 46 is attached to a first bracket 66 located on vertical support 16. A second cable 64 located on sheaves 60, 48 and 50 is attached to a second bracket 68 located on vertical support 18.

The first and second brackets 66 and 68 are identical and only bracket 66 will be described in detail.

As best shown in FIGS. 4, 5 and 6 bracket 66 has first and second plates 70 and 72. Roller bearings 74 and 76 are fixed to first and second plates 70 and 72. Each roller bearing 74, 74′, 76, 76′ has a concave surface which matches the circular surface of the vertical supports 16 and 18. The first and second plates 70, 72 and 70′, 72′ have an angle thereon such that the position of rollers 74, 76 and 74′, 76′ when located on vertical supports 16 and 18 places the top 78 of bracket 66 and top 78′ of bracket 68 in a plane that is substantially perpendicular to vertical supports 16 and 18. It is understood if the vertical supports have a rectangular cross section, the roller bearing will have a cylindrical shape.

Each plate 70, 72 and 70′, 72′ has a flange 80, 80′ which is connected to an end plate 82, 82′ located on arms 84 and 86. Arms 84 and 86 are part of the staves 88, 88′ . . . 88$^N$ that extend over the water adjacent the dock 24 as shown in FIGS. 1 and 2. First and second bars 90 and 93 are attached to the arms 84 and 86 and the staves 88, 88′ . . . 88$^N$ to form a rigid structure. The bars 90 and 93 are parallel to the horizontal member 40 and correspondingly the dock 24.

The weight of the arms 84 and 86 and the staves 88, 88' . . . 88$^N$ act through the arms 84 and 86 to develop a moment that is applied to the brackets 66 and 68 to hold the rollers 74, 76 and 74', 76' against the vertical supports 16 and 18 respectively. U-shaped bars 90 and 90' attached to plates 70, 72 and 70', 72' extend toward the vertical supports 16 and 18 to prevent a counter moment from being developed by the action of the wind on a canopy 108 attached to the bars 91 and 93 and staves 88, 88' . . . 88$^N$.

The canopy 108 as shown in FIGS. 1 and 2 has flaps 92, 94, 96 and 98 that form a skirt that hangs from the bars 91 and 93. Weights or stiffeners 100, 102, 104 and 106 are located on the periphery of the skirt to hold the flap in a substantially vertical plane.

MODE OF OPERATION OF THE INVENTION

The dock-side cover 10 shown in FIG. 1 has the canopy 108 in an up position. When a boat 12 is tied to a pier or post 14 as in FIG. 2, ingress and egress between the interior of the boat 12 and dock 24 is unhampered. When the operator is on the dock 24, crank 55 of winch 52 is released and the first and second cables 62 and 64 allowed to unwind from spool or drum 56. The weight of the canopy 108 acts through the arms 84 and 86 to provide a force which moves the brackets 66 and 68 on the vertical supports 16 and 18 to position the canopy 108 over the boat 12, in a manner as shown in FIG. 3. The skirt of the canopy 108 surrounds a sufficient portion of the boat 12 that is out of the water to prevent water, dirt, dust and other debris in the surrounding environment from entering the interior of the boat. The weights or stiffeners 100, 102, 104 and 106 on the periphery of the flaps 92, 94, 96 and 98 are such that the action of the wind will not blow a flap on top of the canopy 108 and thereafter allow the entry of water or other debris into the interior of the boat 12.

When the operator desires to take the boat 12 away from the dock 24 the canopy 108 is removed from the boat 12 in the following manner:

Crank 55 is turned causing the first and second cables 62 and 64 to wind up on drum or spool 56. It should be noted that sheaves 46 and 48 rotate in opposite directions as the brackets 66 and 68 move on vertical supports 16 and 18.

When the canopy 108 reaches a position as shown in FIG. 1, crank 55 is locked in position. Thereafter, the operator may enter and leave the boat 12 from the dock 24 without being hampered.

Under some circumstances it may be desirable to provide winch 52 with an electrical motor 110 for raising the canopy 108 from the boat 12, as shown in FIG. 7. The electrical motor 110 is connected to drum or spool 52 through gear box 112. Thereafter when the operator desires to move the canopy 108 with respect to the boat 12, switch 114 is operated to allow electrical energy to operate the motor 110.

When the distance between the first and second vertical supports 16 and 18 is over a few feet, the second cable 64 sags in the middle. To eliminate this sag, the horizontal member 40', a section of which is shown in FIG. 8, has a bore 116 located therein to retain the cable 64. In order to assist in the alignment of the cable 64 between spool 52, sheaves 48 and 50, the horizontal member 40' has a slot 118 located adjacent the ends thereof. The shafts 42 and 44 are located above these slots and the sheaves 48 and 50 are located in the bore 116. The sheave 46 is located on the outside of the horizontal member 40' and thus the cables 62 and 64 are separated such that the possibility of tangling is reduced.

Through this invention a removable cover 10 provides a small boat with protection such that an operator need not remove the boat 12 from the water and transport the same to a storage area after each use.

I claim:

1. A cover for protecting the interior of a boat from the surrounding environment, said boat being in the water and secured to a dock, the improvement comprising:

a first vertical support connected to the dock;

a first bracket having a first roller bearing member that engages said first vertical support and a second roller bearing member that engages said first vertical support at a position substantially opposite said first roller bearing member;

a second vertical support connected to the dock;

a second bracket having a third roller bearing member that engages said second vertical support and a fourth roller bearing member that engages said second vertical support at a position substantially opposite said third roller bearing member;

a first arm connected to said first bracket and having an end that extends over the water in a plane substantially perpendicular to said first vertical support;

a second arm connected to said second bracket and having an end that extends over the water in a plane substantially perpendicular to said second vertical support;

a canopy secured to said ends of said first and second arms, said canopy acting through said arms to develop a moment that causes said first, second, third and fourth roller bearing members to engage said first and second vertical supports and hold said first and second arms in said perpendicular plane; and means for moving the first and second brackets with respect to the first and second vertical supports to correspondingly move the canopy from a first position, where the canopy surrounds that portion of the boat out of the water, to a second position, which allows unhampered ingress and egress between the dock and the boat.

2. A cover for protecting the interior of a boat from the surrounding environment, said boat being in the water and secured to a dock, the improvement comprising;

a first vertical support connected to the dock;

a second vertical support connected to the dock;

a horizontal member located between the first and second vertical supports to form a substantially rigid frame;

a first shaft connected to said horizontal member;

first and second sheaves located on said first shaft;

a second shaft connected to said horizontal member;

a third sheave located on said second shaft;

a first bracket located on said first vertical support;

a first arm connected to said first bracket and having an end that extends over the water in a plane substantially perpendicular to said first vertical support;

a first plate and a second plate connected to said first arm;

a first roller bearing member located between said first and second plates and engaging a first side of said first vertical support;

a second roller bearing member located between said first and second plates and engaging said first vertical support opposite said first roller bearing member;

a second bracket located on said second vertical support;

a second arm connected to said second bracket and having an end that extends over the water in a plane substantially perpendicular to said second vertical support;

a third plate and a fourth plate connected to said second arm;

a third roller bearing member located between said third and fourth plates and engaging a first side of said second vertical support;

a fourth roller bearing member located between said third and fourth plates and engaging said second vertical support opposite said third roller member;

a canopy secured to said ends of said first and second arms, the weight of the canopy acting through said first and second arms to create a moment which causes said first, second, third and fourth roller bearing members to engage said first and second vertical supports and hold said first and second arms in said perpendicular plane;

a first cable located on said first sheave and connected to said first bracket;

a second cable located on said second and third sheaves and connected to said second bracket; and a winch connected to said first and second cables, said winch responding to an input signal by winding said cables and moving the first and second brackets with respect to the first and second vertical supports to correspondingly move the canopy from a first position, where the canopy surrounds that portion of the boat out of the water, to a second position, which allows unhampered ingress and egress between the dock and the boat.

3. The cover, as recited in claim 1, wherein said means for moving includes:

a winch;

a first cable connected to said first bracket and said winch; and a second cable connected to said second bracket and said winch, said winch responding to an input signal to move the canopy.

4. The cover, as recited in claim 3, further including:

a horizontal member located between the first and second vertical supports to form a substantially rigid frame.

5. The cover, as recited in claim 4, further including:

a first shaft connected to said horizontal member;

first and second sheaves located on said first shaft, said first cable being located on said first sheave, said second cable being located on said second sheave;

a second shaft connected to said horizontal member; and a third sheave located on said second shaft, said first and second sheaves rotating in opposite directions as the winch moves the first and second cables to position the canopy.

6. The cover, as recited in claim 5, further including:

a brace member secured to each bracket and engaging said vertical supports to prevent the bracket from moving through a second moment caused by the force of the wind acting on the canopy from moving the first and second arms from said perpendicular plane.

7. The cover, as recited in claim 6, wherein said winch includes:

a crank that responds to a manual input to raise and lower the canopy.

8. The cover, as recited in claim 7, further including:

guy members connected to said dock and extending to a fixed anchor position; and means for connecting the first and second vertical supports to said guy members, said fixed anchor position of the guy members holding the first and second vertical supports in a substantially fixed position with fluctuations in said second moment caused by changes in the wind.

9. The cover, as recited in claim 8, further including:

stiffeners connected to the periphery of the canopy to prevent the wind from moving a flap on the canopy and allowing water to enter the boat when the canopy is in said first position.

10. The cover, as recited in claim 6, wherein said winch includes:

an electrical motor;

a gear box connected to the electrical motor;

a drum driven by said gear box, said first and second cables being connected to said drum; and a spacer located on said drum for preventing the first and second cables from becoming intertwined on rotation of the drum during the raising and lowering of the canopy.

11. The cover, as recited in claim 4, further including:

a first shaft connected to the horizontal member adjacent said first vertical support;

a second shaft connected to said horizontal member adjacent said second vertical support;

a first sheave located on said first shaft, said first sheave carrying said first cable from the winch to said first bracket;

a second sheave located on said first shaft;

a third sheave located on said second shaft, said second and third sheaves carrying said second cable from the winch to said second bracket, said first and second cables rotating in opposite directions to simultaneously move the first and second brackets and position the canopy with respect to boat in response to an input force applied to the winch.

12. The cover, as recited in claim 11, wherein said horizontal member has a bore therethrough, said second cable being located in said bore to allow said horizontal member to support said second cable between said second and third sheaves and to protect the second cable from the surrounding environment.

* * * * *